US011454258B2

(12) United States Patent
Reinertz

(10) Patent No.: US 11,454,258 B2
(45) Date of Patent: Sep. 27, 2022

(54) FLUID-DRIVEN DRIVE

(71) Applicant: RHEINISCH-WESTFÄLISCHE TECHNISCHE HOCHSCHULE (RWTH) AACHEN, Aachen (DE)

(72) Inventor: Olivier Reinertz, Kettenis (BE)

(73) Assignee: RHEINISCH-WESTFÄLISCHE TECHNISCHE HOCHSCHULE (RWTH) AACHEN, Aachen (DE)

( * ) Notice: Subject to any disclaimer, the term of this patent is extended or adjusted under 35 U.S.C. 154(b) by 0 days.

(21) Appl. No.: 17/414,152

(22) PCT Filed: Dec. 20, 2019

(86) PCT No.: PCT/EP2019/086548
§ 371 (c)(1),
(2) Date: Jun. 15, 2021

(87) PCT Pub. No.: WO2020/127886
PCT Pub. Date: Jun. 25, 2020

(65) Prior Publication Data

US 2022/0042526 A1 Feb. 10, 2022

(30) Foreign Application Priority Data

Dec. 21, 2018 (DE) ..... 102018222784.5

(51) Int. Cl.
*F15B 15/02* (2006.01)
*F15B 15/20* (2006.01)

(52) U.S. Cl.
CPC ..... *F15B 15/02* (2013.01); *F15B 15/20* (2013.01); *F15B 2015/206* (2013.01)

(58) Field of Classification Search
CPC ..... F15B 15/02; F15B 15/148; F15B 15/20; F15B 2211/70; F15B 2211/7051; B30B 1/42
See application file for complete search history.

(56) References Cited

U.S. PATENT DOCUMENTS 2,135,299 A * 11/1938 Benander ..... B30B 1/16 100/294
3,584,496 A * 6/1971 Keller ..... B30B 1/42 72/430

(Continued)

FOREIGN PATENT DOCUMENTS

DE 2742987 4/1979
DE 2821842 11/1979

(Continued)

OTHER PUBLICATIONS

Search Report for German Patent Application No. 102018222784.5, dated Nov. 18, 2019, 6 pages.

(Continued)

*Primary Examiner* — Thomas E Lazo
(74) *Attorney, Agent, or Firm* — Sheridan Ross P.C.

(57) ABSTRACT

The invention relates to a fluid-driven drive having a movable working surface and a volume-variable cavity, further having an unstable element, wherein given a movement of the working surface in a first movement direction, the unstable element can initially be moved at least in a section with an increased expenditure of force out to an unstable point, wherein when going past the unstable point in the first movement direction, in addition to the force that is provided by fluid pressure, a force exerted by the unstable element is also available in the direction of the first movement direction, wherein given a subsequent movement of the working surface in a second movement direction opposite to the first movement direction, the unstable element can be initially moved with an increased expenditure of force out to an unstable point, wherein when passing the unstable point in the second movement direction, a lower expenditure of force is required for movement at least sectionally.

13 Claims, 8 Drawing Sheets

(56) References Cited

U.S. PATENT DOCUMENTS

| | | | | | |
|---|---|---|---|---|---|
| 3,945,304 | A * | 3/1976 | Taylor | F15B 15/02 | 74/110 |
| 4,149,450 | A * | 4/1979 | Schleicher | F15B 15/02 | 92/140 |
| 7,637,203 | B2 * | 12/2009 | Moss | F04B 35/01 | 92/140 |
| 8,312,804 | B2 * | 11/2012 | Ferrari | F15B 15/02 | 74/110 |
| 2003/0167917 | A1 | 9/2003 | Ball et al. | | |
| 2008/0258654 | A1 | 10/2008 | Neff | | |
| 2014/0141909 | A1 | 5/2014 | Tay | | |

FOREIGN PATENT DOCUMENTS

| | | | | | |
|---|---|---|---|---|---|
| DE | 2821842 | A1 * | 11/1979 | B30B 1/42 | |
| DE | 3208151 | | 9/1983 | | |
| DE | 69225972 | | 2/1999 | | |
| DE | 102010022022 | | 1/2012 | | |
| EP | 2336564 | | 6/2011 | | |
| EP | 2336564 | A1 * | 6/2011 | A47J 31/38 | |
| EP | 3151399 | | 4/2017 | | |

OTHER PUBLICATIONS

International Search Report and Written Opinion for International (PCT) Patent Application No. PCT/EP2019/086548, dated Apr. 14, 2020, 9 pages.

English Translation of the International Search Report for International (PCT) Patent Application No. PCT/EP2019/086548, dated Apr. 14, 2020, 2 pages.

* cited by examiner

FLUID-DRIVEN DRIVE

CROSS REFERENCE TO RELATED APPLICATIONS

This application is a national stage application under 35 U.S.C. 371 and claims the benefit of PCT Application No. PCT/EP2019/086548 having an international filing date of 20 Dec. 2019, which designated the United States, which PCT application claimed the benefit of German Patent Application No. 10 2018 222 784.5 filed 21 Dec. 2018, the disclosures of each of which are incorporated herein by reference in their entirety.

The invention relates to a fluid-driven drive.

BACKGROUND

It is known that in many fluid power systems the deployable force which is exerted by cylinders or membranes is only required in a small region of the travel path of the drive, e.g., the end position. The maximum force that is to be applied during the stroke is thus a defining variable for the design.

Such a situation is crucial for example when designing a pneumatic actuator for clamping processes, press-fitting, compression in pneumatic pressure boosters, compressed air membrane pumps, and so on.

Supplying compressed air is very energy-intensive due to the thermodynamic processes in the compressor.

The compressed air consumption per stroke movement of a pneumatic drive is approximately determined by the product of pressure and volume at the end of the stroke (end position). Exceptions are the servo-pneumatic drives not further examined hereafter, whose compressed air intake corresponds at least to the aforementioned value, but is generally greater due to regulation-related losses.

Consequently, the efficiency of pneumatic drives is particularly poor when a small force is required over a wide range of the stroke but a large force is required at the end of the stroke. In this case, the drive does little work, but a large amount of compressed air is consumed.

Particularly in pneumatic automation technology, it has been observed that the dimensioning of the pneumatic components is difficult. This is particularly due to the fact that standard sizes are utilized and the boundary conditions, such as fluctuations in a pneumatic supply system, resistance forces and process forces, cannot be precisely determined beforehand.

For that reason, pneumatic components in previous systems tend to be largely over-dimensioned to ensure reliable operation even under difficult conditions.

In accordance with the current state of the art, an attempt is made on startup to lower the compressed air consumption by decreasing the supply pressure of machines or individual assemblies by reducing the operating pressure to the necessary pressure. However, due to the large number of components used, this rarely occurs in a drive-specific manner and moreover is generally not adaptive. Thus, the supply pressure is not readjusted to the load and solely the erroneous dimensioning of the actuators is at least partially compensated for from an energy-based perspective.

Providing such actuators with a load-adaptive pressure cutoff in the end position to increase efficiency requires additional complex measures. This complexity is often disproportionately high, so that it is generally omitted, particularly in automation technology.

Due to the currently widespread simple circuit technology, the pressure in the end position thus generally corresponds to the supply pressure, possibly reduced by a pressure reducer. Therefore, the pneumatic drive is designed in such a manner that it can apply the maximum force over the entire forward and return stroke. Regardless of the work actually performed, its compressed air consumption is correspondingly high.

Without taking into account leakage losses, the air consumption in such pneumatic systems is approximately proportional to the number of work cycles, the size of the volumes under pressure, and the density of the compressed air.

An exception would be, for example, compressed air membrane pumps or selected path-controlled cylinders in automation systems, whose reversing valve switches over directly upon reaching the end position without the drive chamber being filled until reaching the supply pressure.

However, even using this measure, the required pressure in the end position of the drive for a given drive volume remains the decisive variable for the compressed air intake while, similar to the use of pressure reduction valves, large quantities of compression energy are unnecessarily dissipated due to the accompanying pressure reduction in the valves.

DE 10 2010 022 022 B4 discloses a blind rivet nut setting device whose tension bolt can be controlled by an integrated pneumatic-hydraulic pressure booster. The pressure regulation used is adaptatively configurable and allows a space-saving construction method. However, this arrangement is also not energy-efficient.

A combined pneumatic and electric actuator is known from US 2008/0 258 654 A1. While it does allow for an improvement, it is comparatively complex and not energy-efficient.

A pneumatic actuator having a membrane system is known from US 2003/0 167 917 A1. However, the system is mechanically complex and not energy-efficient.

US 2014/0 141 909 A1 discloses pneumatic linear actuators having a regulating mechanism based on a pretensioned spring. While it does allow for an improvement, it is comparatively complex and not energy efficient.

OBJECT

On this basis, an object of the invention is to provide an improvement in regard to energy efficiency, with a design that is simple, cost-effective and stable over the long term.

BRIEF DESCRIPTION OF THE INVENTION

The object is achieved by a fluid-driven drive according to claim 1. Additional advantageous designs are in particular the subject matter of the dependent claims, the drawings, and the description.

BRIEF DESCRIPTION OF THE DRAWINGS

The invention is explained below in greater detail with reference to the drawings.

DETAILED DESCRIPTION OF THE INVENTION

Figure 1:
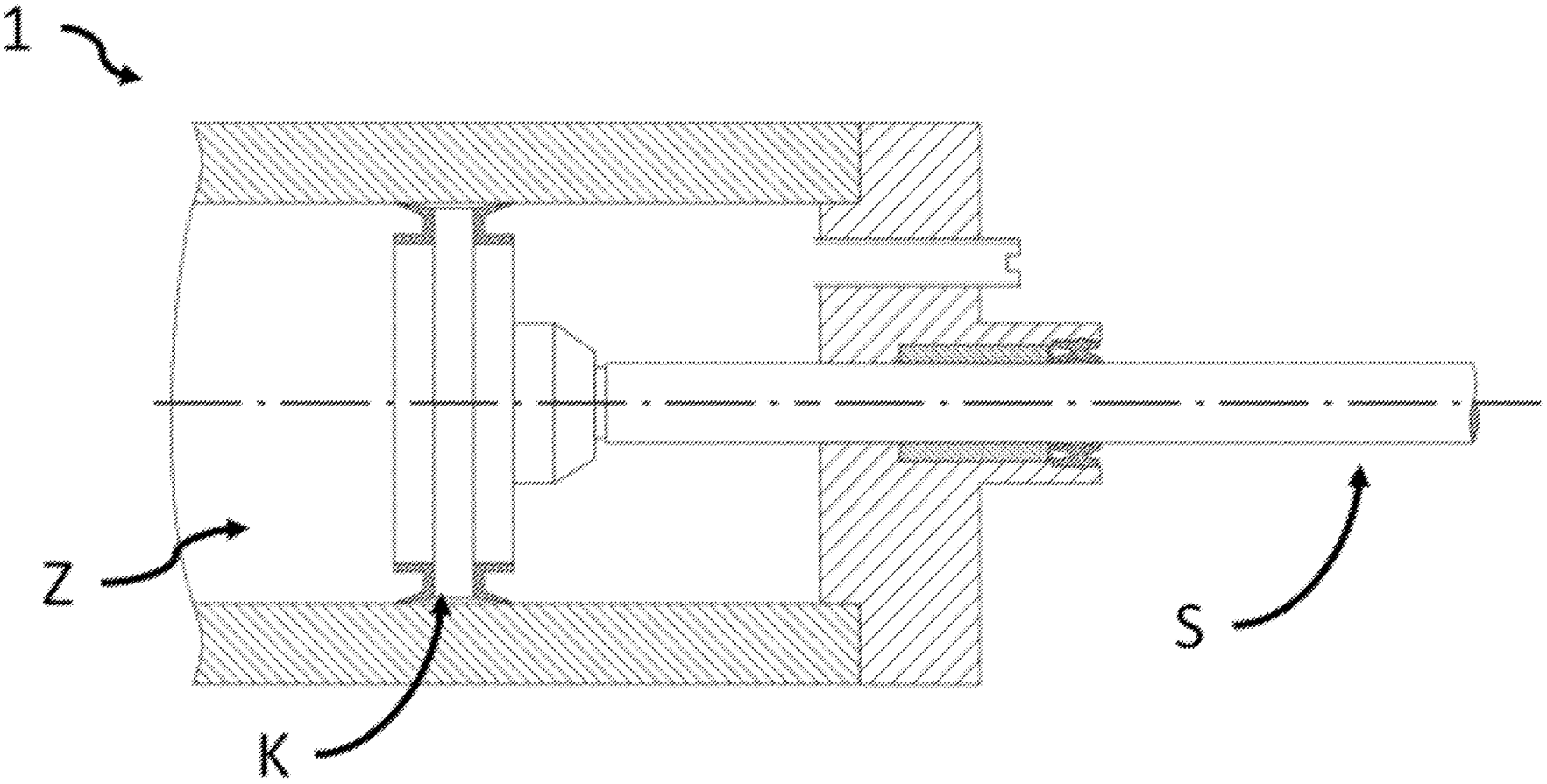
FIG. 1 depicts general aspects of a cylinder.

The invention will be described below in more detail with reference to the drawings. It shall be noted here that various aspects are described each of which may be used individually or in combination. This means that any aspect may be utilized with various embodiments of the invention unless explicitly represented as a mere alternative.

Furthermore, for the sake of simplicity and as a rule, reference will always be made to only one entity. However, unless explicitly noted, the invention may also have several of the entities in question. To that extent, the use of the words "a" and "an" are to be understood only as an indication that at least one entity is being used in a single embodiment.

To the extent that methods are described hereinafter, the individual steps of a method can be arranged and/or combined in any sequence as long as the context does not explicitly provide otherwise. Furthermore, the methods can be combined with one other unless expressly indicated otherwise.

As a rule, specifications having numerical values are not to be understood as exact values, but as having a tolerance of +/−1% to +/−10%.

References to standards or specifications or norms shall be understood to be references to standards or specifications or norms which are or were valid at the time of the application or—if a priority is claimed—at the time of the priority filing. However, this shall not be understood as a general exclusion of the applicability of subsequent or superseding standards or specifications or norms.

The drawings each depict a side view. Unless noted otherwise, all descriptions below always refer to all embodiments.

It has been shown that a pressure reduction and/or the use of pressure reducers can already result in a significant improvement.

For example, at an ambient temperature of 293 K, a density of the fluid in a normal state of 1.183 kg/m$^3$, a specific gas constant of the fluid of 288 J/(kg*k), an isotropic coefficient of 1.4 and a heat capacity of 1,008 J/(kg*K), regulating the pressure from 6 bar to 5.5 bar may result in a mass flow reduction of 8.33%. The change in the specific exergy of the compressed air due to the pressure reduction is 8.69 kJ/m$^3$, corresponding to an exergy loss of 14.5 watts at 100 l/min. However, if the pressure is adjusted from 6 bar to 3 bar, this results in a mass flow reduction of 50%. In this case, the change in the specific exergy amounts to 69.19 kJ/m$^3$, which corresponds to an exergy loss of 115.3 watts at the pressure reducer at 100 l/min.

Therefore, an objective must be to keep the working volume as small as necessary and to prevent pressure drops as much as possible.

The invention solves this by allowing one to use smaller cylinders without adjusting the operating pressure. In order to still apply the requisite forces at the appropriate location, an unstable element E is utilized.

This means that, as shown in FIGS. 2-8, the invention provides a fluid-driven drive 1, illustratively depicted as a cylinder, having a movable working surface depicted as piston K, and a volume-variable cavity depicted as cylinder chamber Z.

The invention will be described below with reference to the embodiment of a cylinder. However, the invention may also be used in a similar fashion in membrane drives. In this case, the working surface is a membrane that is moved (displaced).

The fluid-driven cylinder 1 also has an unstable element E.

Given a movement (displacement) of the piston K in a first movement direction (displacement direction), the unstable element E can be moved (displaced)—directly or indirectly by means of the piston K—initially at least in a section A1 by expending greater force, thus by consuming energy, out to an unstable point LP.

When going past the unstable point LP in the first movement direction (displacement direction) (forward direction), there is, in addition to the force provided by fluid pressure, also available a force exerted by the unstable element E in the direction of the first movement direction (displacement direction).

This means that even though a small cylinder is used and that there is thus a smaller working volume, a high force can still be exerted (in the end position).

In a subsequent displacement of the piston K in a second movement direction (displacement direction) (rearward direction), which is opposite the first movement direction (displacement direction), the unstable element E can first be moved (displaced) under an increased expenditure of force out to an unstable point LP, wherein when passing the unstable point LP in the second movement direction (displacement direction), a smaller expenditure of force is required at least sectionally for the displacement.

It shall be noted here that in simple executions, the unstable point in the forward direction and in the rearward direction coincide. However, unstable elements may also be used with different (or also multiple) unstable points. However, this is not relevant to understand the invention.

Since small cylinders having smaller working volumes can now be used, the working pressure and/or the volume can be decreased so that, compared to prior designs, possible losses can be decreased and efficiency increases overall.

Figure 2:
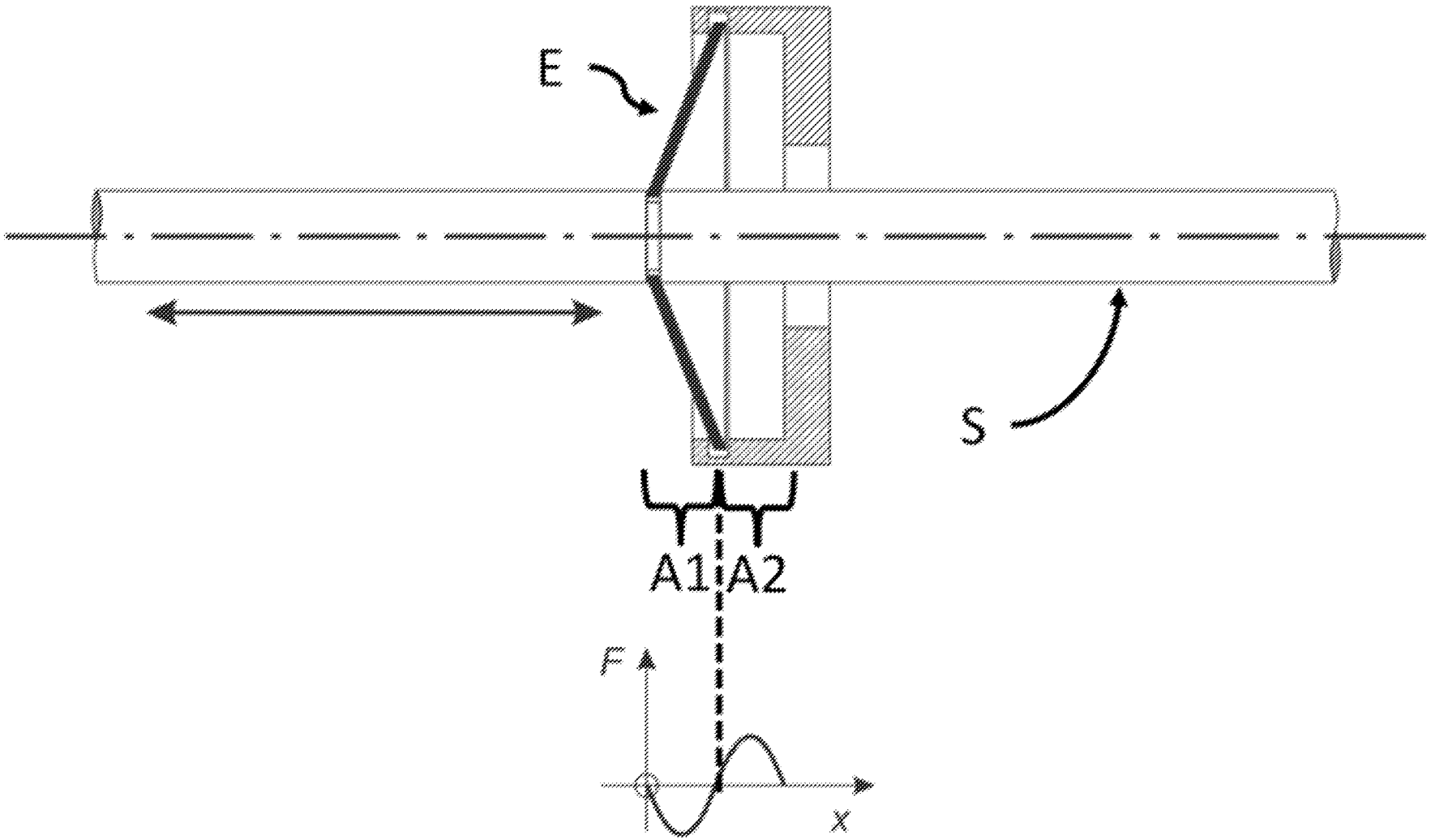
FIG. 2 depicts an embodiment of elements according to the invention.

An example of a simple execution of an unstable element E is depicted in FIG. 2. Said element has a simple mechanical element, for example a snap action-type spring.

The spring may be mounted for example in a membrane-like manner in a mechanical receiver and be entrained by a groove-like recess in the tappet S. Until reaching the unstable point LP, a force opposing the movement thereby builds up, which acts in a force-amplifying manner in the movement direction (displacement direction) after passing the unstable point LP.

Figure 3:
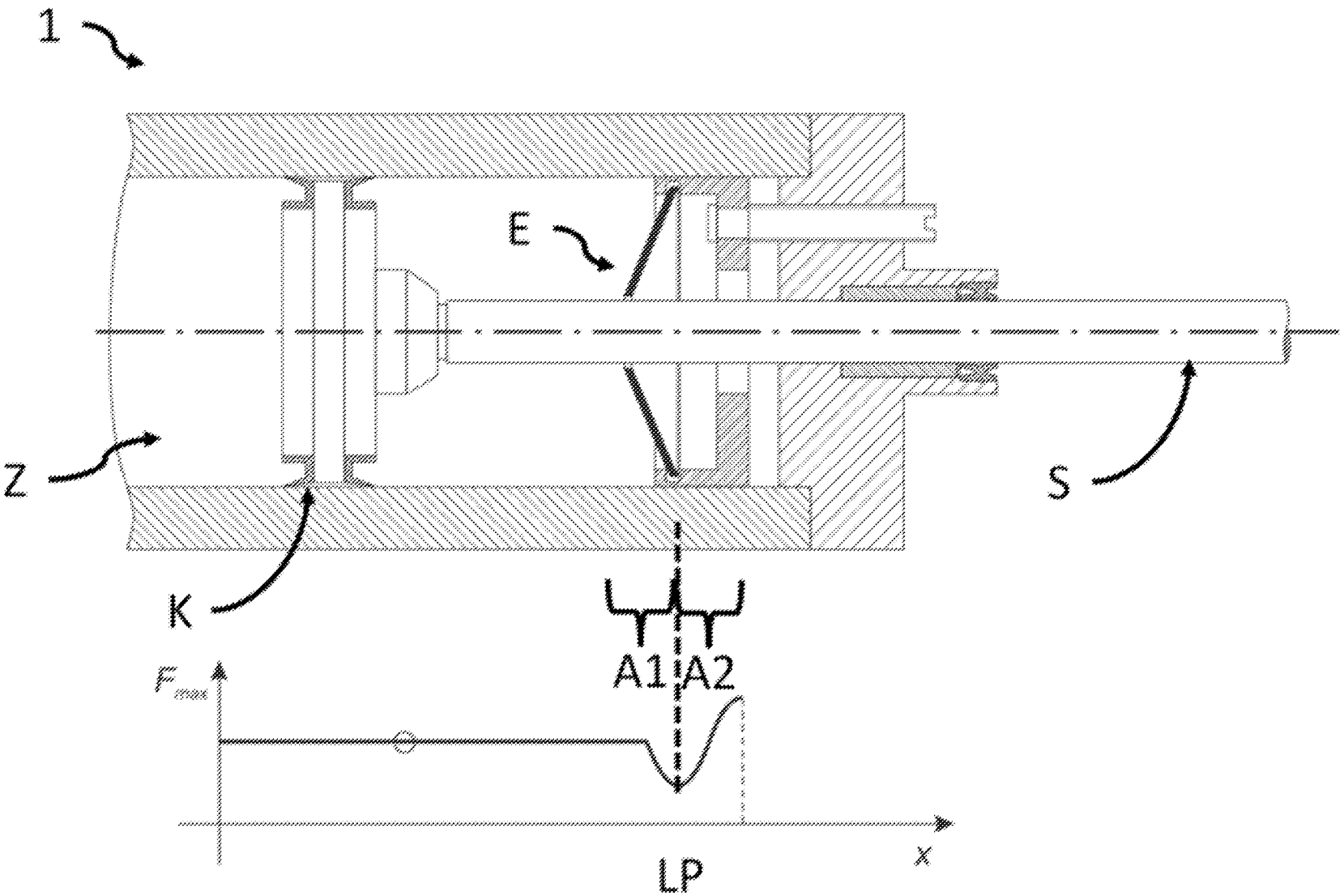
FIG. 3 depicts a first arrangement of embodiments of elements according to the invention.
Figure 4:
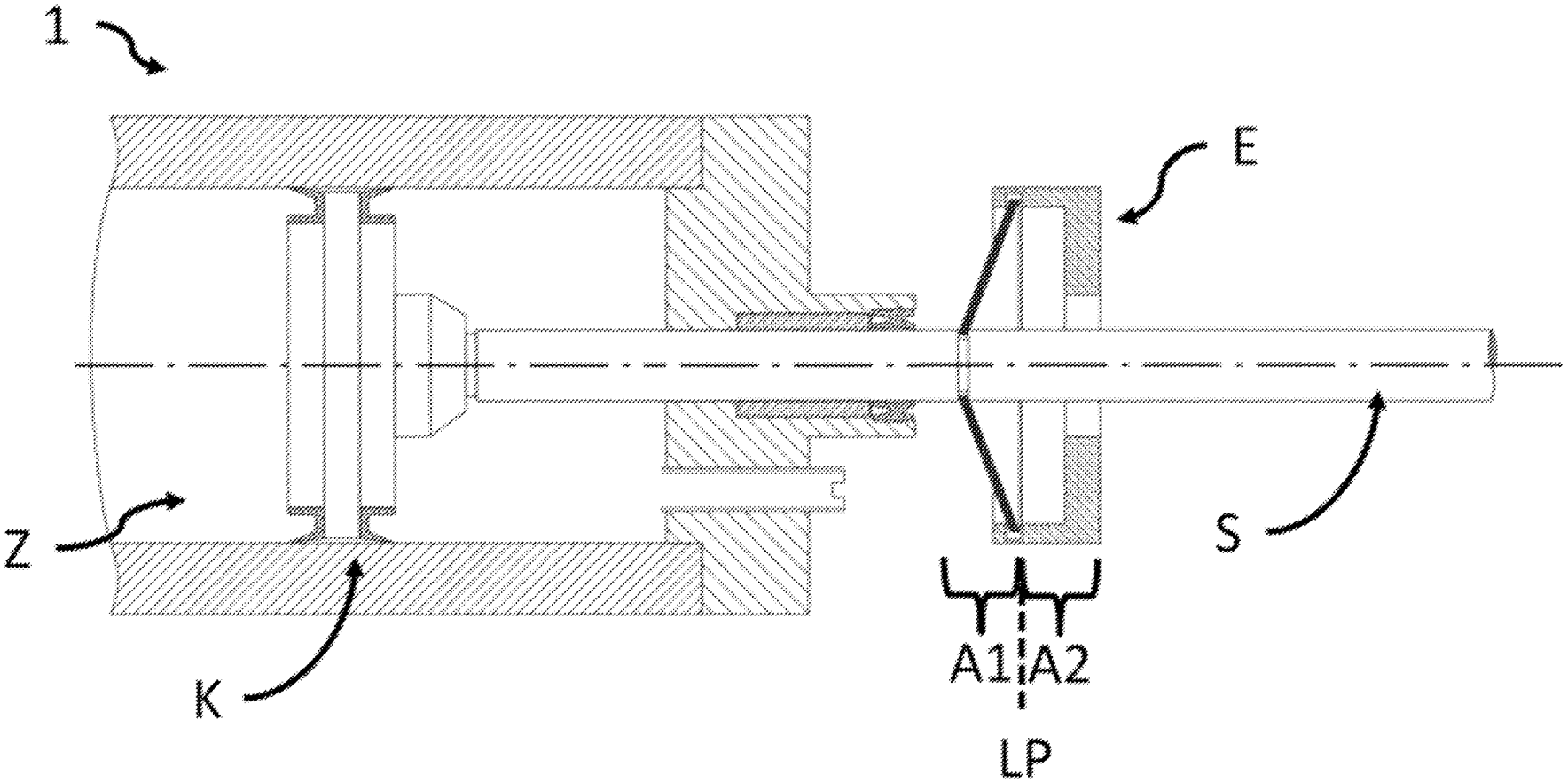
FIG. 4 depicts a second arrangement of embodiments of elements according to the invention.

As can be seen in FIGS. 3 and 4, the installation location for the unstable element E may be suitably selected. Thus, the unstable element may be located inside the cylinder chamber Z as shown in FIG. 3, or be located outside of the cylinder chamber Z as shown in FIG. 4.

This means that the invention can be arranged compactly in the cylinder chamber or in a maintenance-friendly manner outside of the cylinder chamber.

In FIG. 3, the unstable element E acts as an end position force amplifier in the cylinder.

Figure 5:
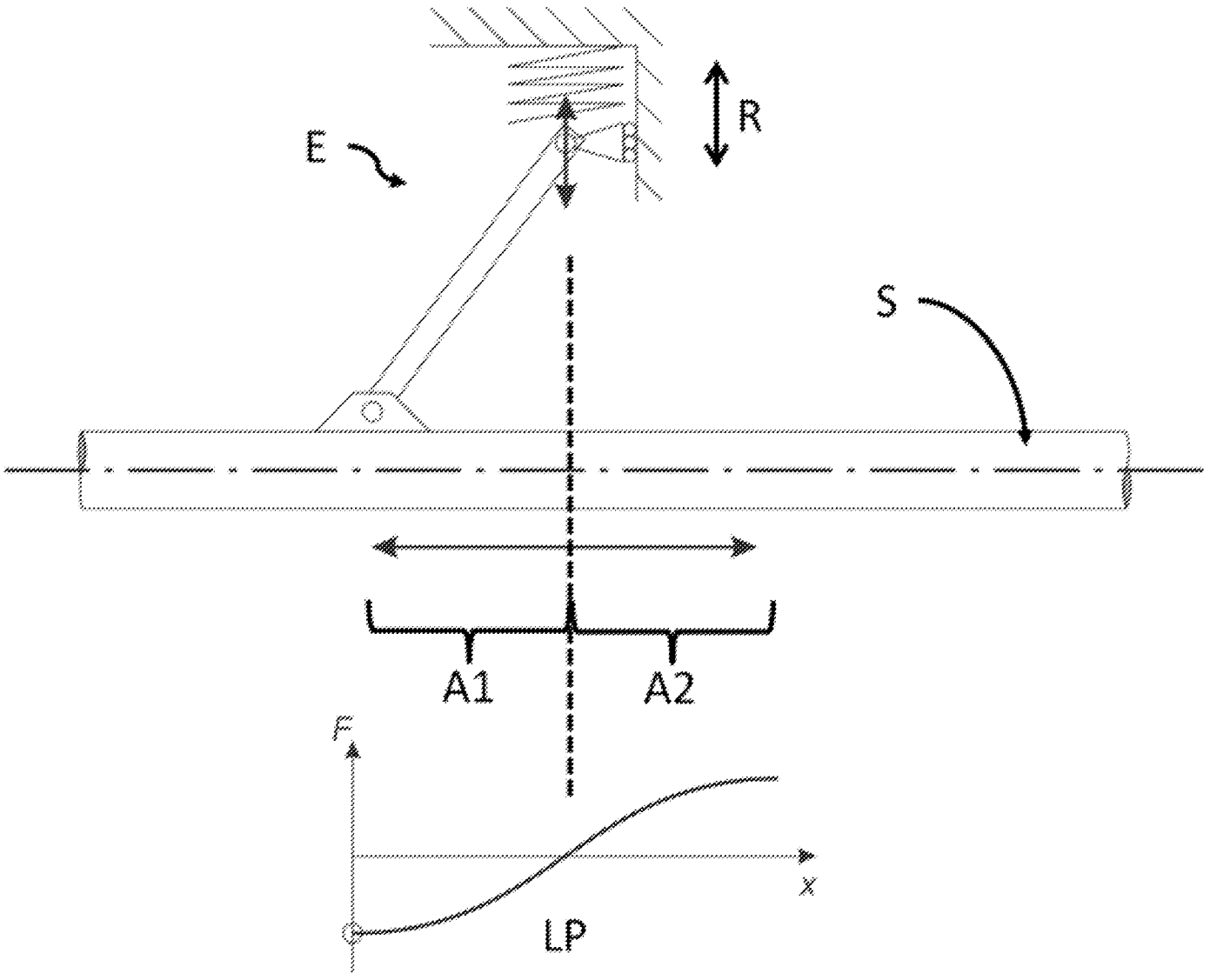
FIG. 5 depicts a second embodiment of elements according to the invention.

A modified arrangement having a different force characteristic is shown in FIG. 5. Here, the unstable element is provided by means of lever kinematics on a spring.

It shall be noted that, for example in the embodiment of FIG. 5, the force curve can be further influenced by configuring the curve of the spring constant of the spring.

Alternatively or additionally, a modification of the stop of the spring/active modification of the spring constant—indicated by R—can be provided, by means of which the force curve can also be configured in an adjustable manner in the course of the process. This includes the relative position in relation to the movement path (displacement path) and/or the amount of the force. On the other hand, as already explained earlier in relation to FIGS. 3 and 4, the unstable element can be arranged both inside and outside the cylinder chamber.

Figure 6:
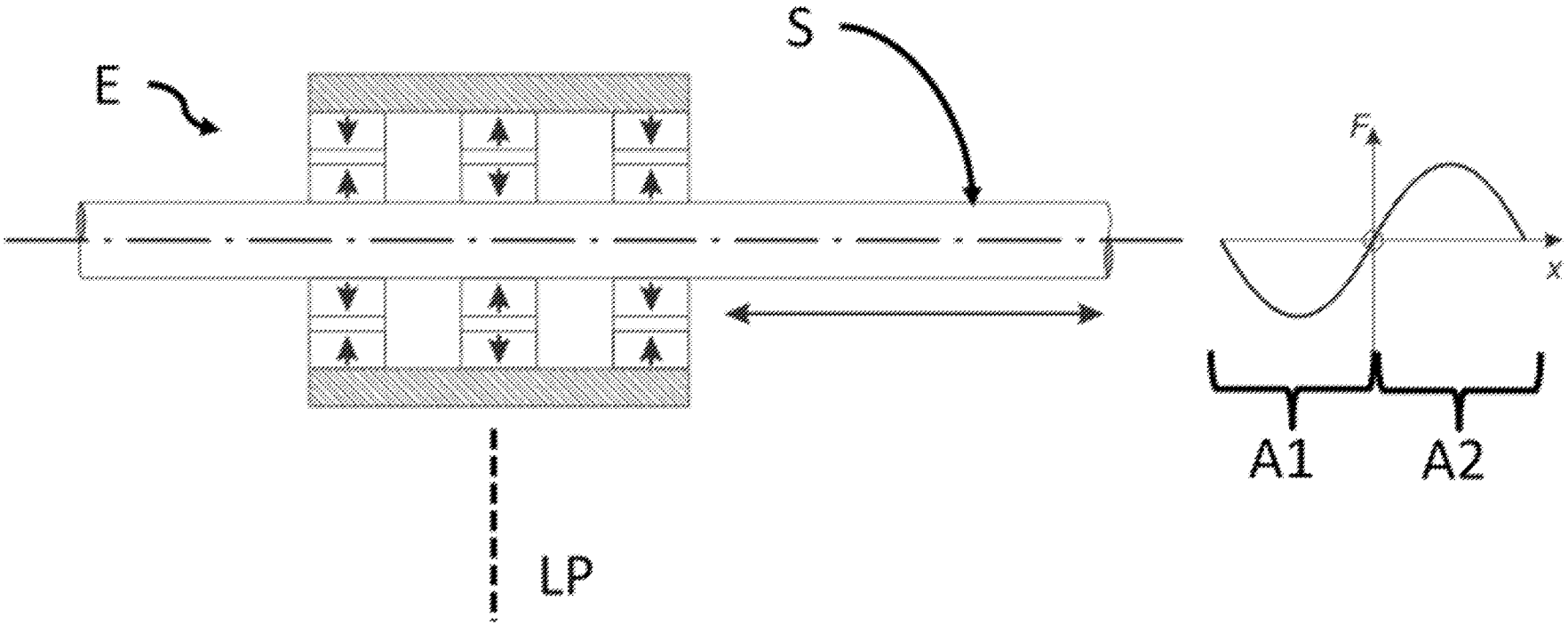
FIG. 6 depicts a third embodiment of elements according to the invention.
Figure 7:
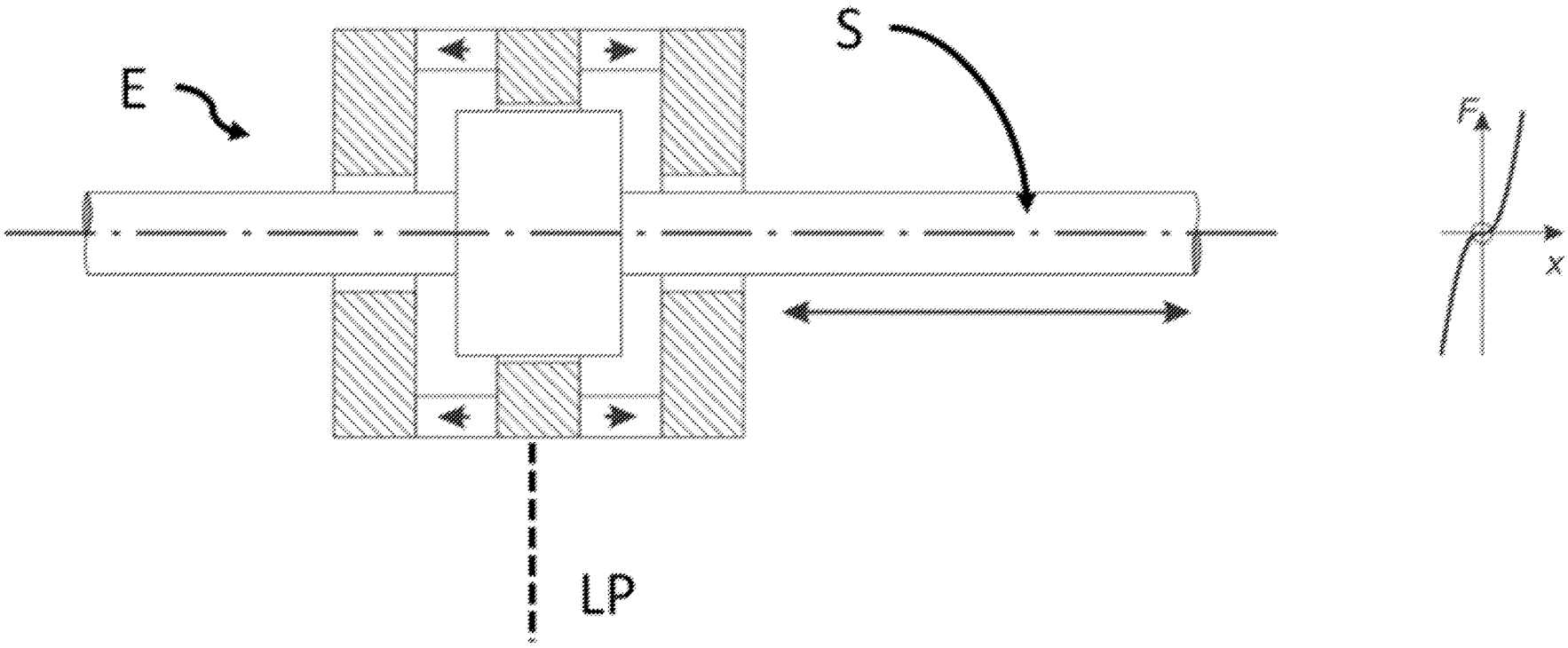
FIG. 7 depicts a fourth embodiment of elements according to the invention.

In embodiments depicted in FIGS. 6 and 7, the unstable element E has a magnetic element. The magnetic poles are represented by differently oriented arrows. Here, too, one can influence the force curve by the appropriate orientation of the magnetic poles. Once again, as already explained earlier in relation to FIGS. 3 and 4, the unstable element can be arranged both inside and outside the cylinder chamber.

Likewise, instead of permanent magnets, which require no electrical energy, one can alternatively or additionally use electromagnets. Similar to the modification of the spring path/spring constant—as explained in FIG. 5—the force curve can hereby also be configured in an adjustable manner in the course of the process. This includes the relative position in relation to the movement path (displacement path) and/or the amount of the force.

Figure 8:
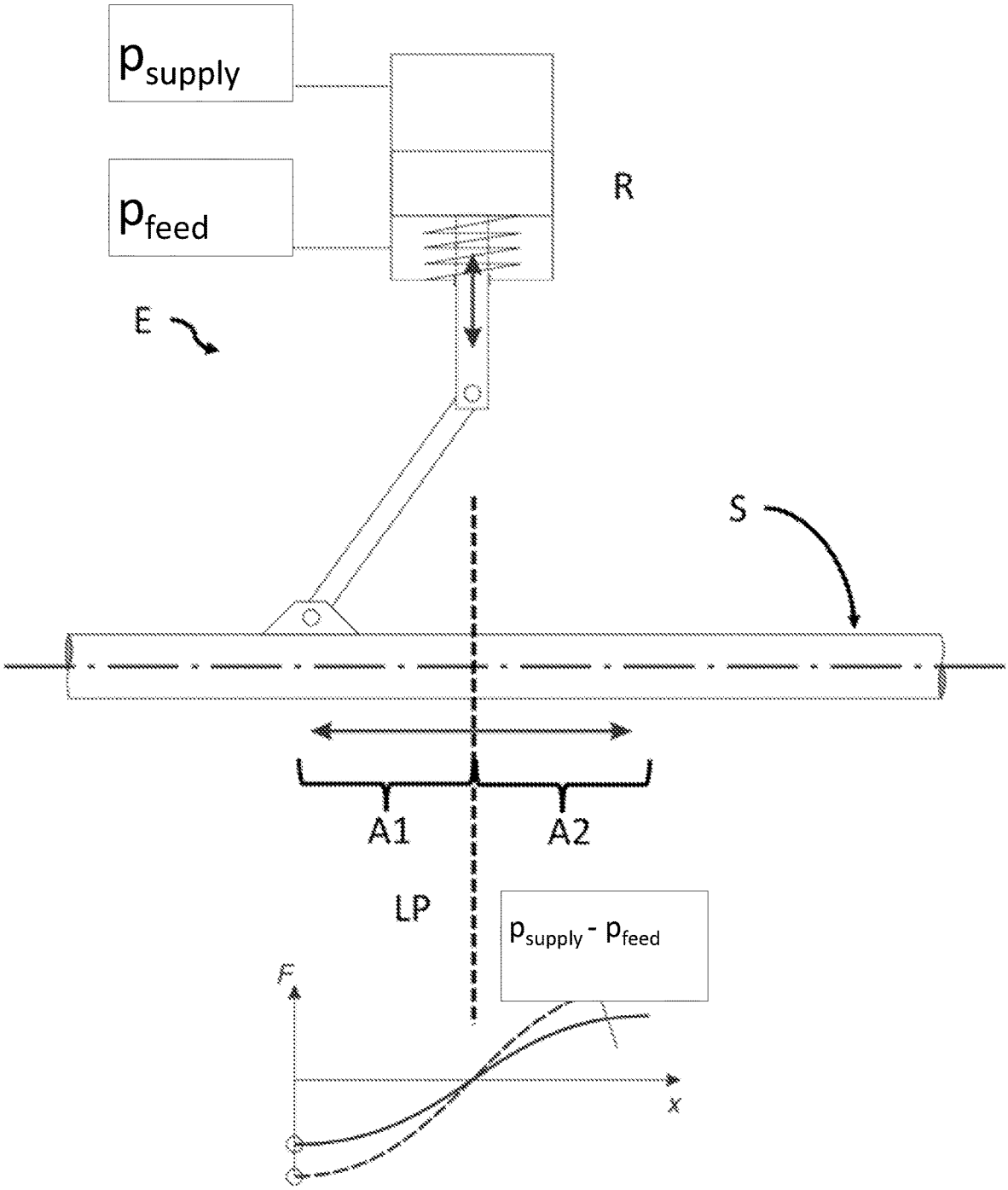
FIG. 8 depicts a fifth embodiment of elements according to the invention, along with an additional aspect.

FIG. 8 depicts another embodiment in which the principle of FIG. 5 is supplemented by an adaptive component. Adaptive mechanics, for example, can be provided here for compressed air membrane pumps and pressure boosters.

The invention discloses the use of bistable mechanics for the load-adapted force generation of pneumatic actuators (particularly cylinders or membranes), for example by means of pretensioned membranes (snap action effect). These bistable mechanics have at least one unstable point LP. At this unstable point LP, there is practically no further force required to transition into another state. This change of state also results in a force action and a displacement.

Depending on the embodiment, the load adjustment can be specified geometrically as well as be updated to the current process variables by adaptation—as shown in FIG. 8.

The force in the end position is often relevant for designing a pneumatic actuator (clamping processes, press fitting, compression in pressure boosters, compressed air membrane pumps, etc.).

The product of pressure and volume at the end of the stroke determines the compressed air consumption of a drive. Therefore, the efficiency of pneumatic drives is particularly poor when a large amount of force is required at the end of a stroke, but little force is needed over large portions of the stroke. In this case, the drive consumes a large amount of compressed air, but little work is done.

In accordance with the invention, energy is stored in the unstable element E in a first path segment during the stroke, in other words the maximum possible output force of the actuator is reduced, while said force is released again as the stroke increases. By means of the additionally applied mechanical force of the bistable mechanics, the pressure requirement or working surface can be reduced given the same actuator force in the end position, so that the compressed air consumption can be reduced.

Particularly for clamping tasks requiring a large force only in a relatively small stroke region, the efficiency can even be increased by 20%, 30% and more under realistic conditions and using simple mechanics.

Significant efficiency increases can also be achieved in pneumatically driven pressure boosters and membrane pumps.

The mechanics according to the invention can also result in a reduction of the required installation space.

a) The bistable mechanics (such as a bistable spring in the form of a pretensioned membrane, a spring- or pressure-loaded lever gearbox or a magnetic system) are specifically suited for pneumatic actuators and, given a constant working surface of the drive, result in a reduction of the required pressure in the end position.

b) Use of the mechanics saves energy, so that the invention involves an energy-efficient system.

c) Additional advantages: Installation space can be reduced by decreasing the working surface; and the bistable mechanics are robust and comparatively cost-effective and can be adaptively designed in accordance with the force required.

Integrating an unstable element E, for example in the form of a pretensioned membrane (snap action effect), a spring- or pressure-loaded lever gearbox or a magnetic system, etc., allows one to decrease the required force by storing it beforehand in the bistable mechanics.

Thus, for a given amount of force, the compressed air intake is significantly reduced in the end position or at another point specified by the user (for adjustable mechanics).

Given a known cycle (e.g., in membrane pumps or pressure boosters), the mechanics can be optimized to the operation during the design stage.

Given a variable force required in the end position (e.g., for compressed air membrane pumps with fluctuating feed pressure $p_{feed}$), one can also adaptively configure the mechanics.

By means of the invention, one can achieve energy savings while simultaneously reducing the installation space.

What is claimed is:

1. A fluid-driven drive, comprising:

a movable working surface;

a volume-variable cavity; and an unstable element, wherein given a movement of the working surface in a first movement direction, the unstable element is initially moved at least in a section with an increased expenditure of force out to a first unstable point, wherein when going past the first unstable point in the first movement direction, in addition to a force that is provided by fluid pressure, a force exerted by the unstable element also occurs in the direction of the first movement direction, wherein given a subsequent movement of the working surface in a second movement direction opposite to the first movement direction, the unstable element is initially moved with an increased expenditure of force out to a second unstable point, wherein when passing the second unstable point in the second movement direction, a lower expenditure of force is required for movement of the working surface for at least a section of the movement in the second movement direction, and wherein during the movement of the working surface in the first movement direction, energy is stored in the unstable element and a maximum output force of an actuator creating the fluid pressure is reduced, wherein the stored energy is released during the movement of the working surface in the second movement direction.

2. The fluid-driven drive according to claim 1, wherein the unstable element is located inside the cavity.

3. The fluid-driven drive according to claim 1, wherein the unstable element is located outside of the cavity.

4. The fluid-driven drive according to claim 1, wherein the unstable element is a mechanical element.

5. The fluid-driven drive according to claim 4, wherein the mechanical element has a snap action-like spring.

6. The fluid-driven drive according to claim 1, wherein the unstable element is a magnetic element.

7. The fluid-driven drive according to claim 1, wherein the unstable element is adjustable in terms of its force action.

8. The fluid-driven drive according to claim 1, wherein the unstable element has a bistable mechanical structure with a first stable state and a second stable state.

9. The fluid-driven drive according to claim 8, wherein the unstable element transitions from the first stable state to the second stable state upon passing the first unstable point in the first movement direction.

10. The fluid-driven drive according to claim 9, wherein the unstable element transitions from the second stable state to the first stable state upon passing the second unstable point in the second movement direction.

11. The fluid-driven drive according to claim 10, wherein the first unstable point coincides with the second unstable point.

12. The fluid-driven drive according to claim 1, wherein the first unstable point coincides with the second unstable point.

13. The fluid-driven drive according to claim 1, wherein the working surface comprises a tappet with a groove that mechanically receives the unstable element.

* * * * *